US006766922B2

(12) United States Patent
da Silva

(10) Patent No.: US 6,766,922 B2
(45) Date of Patent: Jul. 27, 2004

(54) SQUEEZE-SPRAY DEVICE

(76) Inventor: Reginaldo Alexandre da Silva, Lever Faberge Ltd. Coal Road, Seacroft Leeds, LS142AR (GB)

( * ) Notice: Subject to any disclaimer, the term of this patent is extended or adjusted under 35 U.S.C. 154(b) by 0 days.

(21) Appl. No.: 10/369,260

(22) Filed: Feb. 18, 2003

(65) Prior Publication Data

US 2003/0155375 A1 Aug. 21, 2003

(30) Foreign Application Priority Data

Feb. 19, 2002 (EP) ..... 02251124

(51) Int. Cl.[7] ..... B65D 37/00
(52) U.S. Cl. ..... 222/211; 222/525
(58) Field of Search ..... 222/211, 525

(56) References Cited

U.S. PATENT DOCUMENTS

| | | | | |
|---|---|---|---|---|
| 4,020,979 A | | 5/1977 | Shay et al. | 222/211 |
| 4,102,476 A | | 7/1978 | Loeffler | 222/209 |
| 4,226,367 A | | 10/1980 | Hayes | 239/327 |
| 4,432,496 A | | 2/1984 | Ito | 239/327 |
| 4,561,570 A | | 12/1985 | Zulauf et al. | 222/153 |
| 5,137,183 A | * | 8/1992 | Mikulec et al. | 222/192 |
| 5,240,149 A | | 8/1993 | Schmidt | 222/212 |
| 5,285,933 A | * | 2/1994 | Gentes et al. | 222/148 |

FOREIGN PATENT DOCUMENTS

| | | |
|---|---|---|
| DE | 1 761 841 | 7/1968 |
| EP | 439 109 | 7/1991 |
| GB | 2 284 202 | 5/1995 |

* cited by examiner

*Primary Examiner*—Philippe Derakshani
(74) *Attorney, Agent, or Firm*—Kevin J. Stein

(57) ABSTRACT

A squeeze spray device is described comprising a deformable bottle (1) for holding a liquid composition, a leave-in-place dispenser cap (5), and a dip-tube (50); said dispenser cap comprising:

a) a base section (5B), comprising a means (15) for attachment to the deformable bottle, a segment (22) defining at least one aperture and a receiver (27B) for the dip-tube on the interior face of said segment (22), the at least one aperture providing fluid connection between the interior of the deformable bottle (1) and exterior to the base section (5B), both via the dip-tube and otherwise; and b) a moveable member (10), retained exterior to the base section, comprising a cover (14, 38) for said segment of the base section, said cover defining a spray hole (40);

the moveable member (10) functioning to change the device between an inoperable state in which the spray hole (40) is blocked from within by a blocking means (26) that forms a part of the base section (5B) and an operable state in which the cover (14, 38) defining the spray hole (40) is at a distance from said blocking means (26).

25 Claims, 4 Drawing Sheets

SQUEEZE-SPRAY DEVICE

TECHNICAL FIELD

The present invention relates to a squeeze-spray device and to a method of application of a liquid cosmetic composition to the human body.

BACKGROUND

Many forms of device for applying liquid cosmetic compositions are known. For spray application, propellant-driven aerosol devices are widely used. Alternatively, squeeze spray devices may be employed. Unfortunately, squeeze spray dispensing of liquid compositions commonly leads to poor spray quality, which, in turn, leads to unfavourable sensory perception when the composition is applied to the human body.

Squeeze spray devices of the prior art are generally unsophisticated devices and have the disadvantage of being prone to accidental discharge when inadvertently put under pressure—for example, when being carried in a handbag or a jacket pocket. Such accidental discharge not only wastes the product, but may also lead to inconvenient damage or cleaning requirements for the accidentally sprayed substrate.

Numerous publications exist in the literature on squeeze spray devices, some addressing one or more of the aforementioned problems. GB 2,284,202 (1994, Gene Stull) discloses a closure cap for a squeeze bottle, which, when opened, enables multi-stream spraying of the enclosed product. U.S. Pat. No. 5,240,149 (1993, Perfect-Valois Ventil) also discloses a closure cap for a squeeze bottle, although the outlet valve of disclosed closure cap may be opened simply by squeezing the bottle. U.S. Pat. No. 4,226,367 (1980, Hayes) discloses a squeeze spray device with a rotatable cap and alignable orifices. U.S. Pat. No. 4,102,476 (Ciba-Geigy) discloses a squeeze bottle device with an air check valve on the cover. U.S. Pat. No. 4,02,0,979 (1977, Summit Packaging Systems) discloses a squeeze spray device offering improved spray atomisation.

INVENTION

The present invention overcomes the aforementioned mentioned problems associated with many earlier squeeze spray devices. Other benefits may include ease of use, in particular one-handed use; robustness; and ease of manufacture.

When used to apply a liquid cosmetic composition to the human skin the devices described herein, in particular the preferred embodiments, lead to good sensory perception of the composition by the user.

According to a first aspect of the present invention, there is provided a squeeze spray device comprising a deformable bottle for holding a liquid composition, a leave-in-place dispenser cap attached to the deformable bottle, and a dip-tube, one end of said dip-tube being received by the dispenser cap and the other end terminating inside the deformable bottle; said dispenser cap comprising:

a) a base section, comprising a means for attachment to the deformable bottle, a segment defining at least one aperture and a receiver for the dip-tube on the interior face of said segment, the at least one aperture providing fluid connection between the interior of the deformable bottle and exterior to the base section, both via the dip-tube and otherwise; and b) a moveable member, retained exterior to the base section, comprising a cover for said segment of the base section, said cover defining a spray hole;

the moveable member functioning to change the device between an inoperable state in which the spray hole is blocked from within by a blocking means that forms a part of the base section and an operable state in which the cover defining the spray hole is at a distance from said blocking means.

According to a second aspect of the present invention, there is provided a dispenser cap suitable for use as part of a squeeze spray device according to the first aspect of the invention.

According to a third aspect of the present invention, there is provided a method of topical application of a liquid cosmetic composition comprising the use of a squeeze spray device as described in the first aspect of the invention.

According to a fourth aspect of the present invention, there is provided a consumer product comprising a squeeze spray device as described in the first aspect of the invention containing a liquid composition.

With regard to the third and fourth aspects of the invention, the squeeze spray device of the present invention may be used with a variety of liquid compositions. It is suitable for topical application of a liquid cosmetic composition to the human body, in particular deodorant, antiperspirant, hair spray, and perfume compositions. Cosmetic compositions that are especially suitable are deodorant and antiperspirant compositions; the consumer may gain efficacy and/or sensory benefits with such compositions. The composition may be in the form of a homogeneous solution, an emulsion, or a suspension of one or more components in a liquid carrier material. Homogeneous solutions are the most preferred option because of their comparative stability and lack of problems with dispenser blockage.

The sensory and/or efficacy benefits referred to above are particularly noticeable when the composition used with the device is a liquid cosmetic composition for application to the human body that comprises a C2 to C4 alcohol, for example ethanol, propylene glycol, propanol, or iso-propanol. Suitable compositions typically comprise C2 to C4 alcohol at a level of from 5% to 95%, in particular from 25% to 80%, and especially from 40% to 75% by weight of the composition. Liquid compositions comprising ethanol are particularly suitable.

The deformable bottle may be of any shape; for example, it may be a straight-sided jar or flask, or it might have a waisted design. Preferably, the bottle is of tubular shape, with a base upon which it can stand upright, without falling over. The base may be essentially flat. It is preferred that the base is raised towards the interior of the bottle in a central region. The cross-section of the bottle is preferably circular. Another preferable feature is the presence of a neck portion, onto which the dispenser cap may be attached. Typical dimensions, excluding any neck portion, are from 5 cm to 20 cm for the height and, independently, from 3 cm to 8 cm for the diameter of a container of circular cross-section or from 3 cm to 12 cm for the greatest cross-sectional dimension of a container of non-circular cross-section. The sidewalls of the tubular container have a thickness enabling them to be deformable under hand-pressure, a typical thickness being from 0.3 mm to 1.2 mm. The base preferably has a thickness of from 0.6 mm to 2.5 mm.

The bottle may be made from any suitable plastic material; for example, polyethylene. A mixture of high- and low-density polyethylene may advantageously be employed.

When the deformable bottle is being used as part of a squeeze spray device suitable for topical application of a liquid cosmetic composition, its internal volume is typically from 10 $cm^3$ to 300 $cm^3$, particularly from 30 $cm^3$ to 200 $cm^3$, and especially from 50 $cm^3$ to 150 $cm^3$.

A dispenser cap is attached to the deformable bottle of the squeeze spray device. The dispenser cap is not removed during use of the squeeze spray device—this is what is meant by "leave-in-place".

The dispenser cap comprises a base section attached to the deformable bottle by some form of attachment means. A suitable attachment means is a screw-threaded tube designed to mate with a screw-threaded tube on a neck portion of the deformable bottle. Alternatively, the attachment means may be a friction fit onto the deformable bottle and/or lugs that interact with lugs on an adjoining surface on the base section. When the attachment means comprises screw-threaded elements as described above, it is preferred that there is also present a means of preventing over-tightening of the screw-threaded elements.

Preferably the base section comprises an outer skirt that fits over an upper part of the sidewall of the deformable bottle. This feature can aid the retention of the base section onto the deformable bottle. In particularly preferred embodiments, the lower edge of the outer skirt is shaped to fit into a correspondingly shaped indentation in the sidewall of the deformable bottle. This feature can prevent over-tightening of a screw-thread when the attachment means of the base section to the deformable bottle comprises such a feature. A suitable shape for the lower edge of the outer skirt is saddle-shaped.

The base section serves to largely close the deformable bottle; however, a segment of the base section defining at least one aperture provides fluid connection between the interior of the deformable bottle and exterior to said segment. The segment has a receiver for the dip-tube on its interior face (i.e., facing the interior of the deformable bottle) and the one or more apertures provide fluid connection with the interior of the deformable bottle both via the dip-tube and otherwise. The receiver is a structure that holds one end of the dip-tube in close proximity to the interior face of the base section without closing or blocking the bore of the dip-tube.

In certain embodiments, the receiver is in the interior of a tube projecting outwards from the base section (i.e., away from the deformable bottle). The outward-projecting tube generally has the segment of the base section defining at least one aperture at its outer end. Preferably, the interior of the tube comprises a portion of polygonal cross-section, triangular cross-section being particularly preferred. In these certain embodiments, the segment of the base section defining at least one orifice preferably defines a number of orifices equal to the number of sides of the portion of the interior of the tube of polygonal cross-section.

In preferred embodiments, the segment of the base section defining the at least one aperture is tubular in overall shape, preferably narrowing towards its outer end, ie. having a frusto-conical shape. The tubular segment may be located centrally at the outer end of an outward-projecting tube as described in the previous paragraph and share a common axis therewith. Preferably the tubular segment defining the at least one orifice is narrower than the outward-projecting tube, i.e. it has a smaller maximum outer dimension orthogonal to the axis than the corresponding outer dimension of the outward-projecting tube. Preferably, the at least one aperture is a slit running longitudinally through the sidewall of the tubular section.

The fluid connection between the interior of the deformable bottle and exterior to the segment of the base section defining the at least one aperture is provided both via the dip-tube and otherwise. The fluid connection other than via the dip-tube provides a means for air to pass between the interior of the deformable bottle and exterior to the segment of the base section defining the at least one aperture. When more than one aperture is defined by said segment of the base section, then two distinct embodiments are possible. In a first embodiment, each aperture independently provides fluid connection between the interior of the deformable bottle and exterior to said segment of the base section both via the dip-tube and otherwise. In a second embodiment, one or more apertures provide fluid connection between the interior of the deformable bottle and exterior to said segment of the base section without fluid connection via the dip-tube. In this latter embodiment, the fluid connection via the dip-tube is provided by one of the other apertures.

The number of orifices defined by the aforementioned segment of the base section is preferably at least three, three orifices being particularly preferred.

The base section comprises a blocking means for a spray hole (vide infra), said blocking means being a continuous surface on the exterior face of the base section of size sufficient to block said spray hole. Preferably the blocking means is at the outer end of a tubular element projecting outwards from the base section. More preferably, the tubular element comprises the segment of the base section that defines the at least one aperture. In the preferred embodiments in which said segment is tubular in overall shape, it is particularly preferred that said segment is closed at its outer end by the blocking means.

The dispenser cap also comprises a moveable member retained exterior to the deformable bottle. The moveable member is capable of changing the device from an inoperable to an operable state, and vice-versa. The member is retained in such a manner that it is not removed from the device, whether the device is in its operable state, its inoperable state, or in some intervening state. Preferably the moveable member is attached to the base section of the dispenser cap. The attachment means may comprise a tongue and groove arrangement and is preferably located at the side of the dispenser cap.

The moveable member comprises a cover for the segment of the base section defining at least one aperture, said cover defining a spray hole which is blocked from underneath by the aforementioned blocking means when the device is in its inoperable state. When the device is in its operable state, the cover defining the spray hole is at a distance from the blocking means, said distance being non-zero.

In preferred embodiments, the segment of the base section defining at least one aperture and the cover therefor form a swirl chamber where air and a liquid composition from the deformable bottle are mixed together prior to exiting through the spray hole. The air and the liquid composition are forced into the swirl chamber from the deformable body by squeezing thereof, in a preferred mode of operation.

In one embodiment, the device is changeable between its operable and its inoperable states by sliding the cover away from and towards the blocking means, respectively. In a second embodiment, the device is changeable between its operable and its inoperable states by screwing the cover away from and towards the blocking means, respectively. The former embodiment is preferred for ease of one-handed use.

In preferred embodiments, the cover defining the spray hole is a plate substantially orthogonal to the top-bottom axis of the device. The plate is moveable from a lower position in which the spray hole is blocked from underneath by the blocking means and the device is inoperable, to an upper position in which the spray hole is at a distance from the blocking means and the device is operable. The substantially orthogonal plate may be convex when viewed from the exterior and may be shaped to fit into an indentation in an outer portion of the base section.

The cover defining the spray may be attached to a side piece which is slid up or down the side of the dispensing cap to raise or lower the plate, thereby changing the device between its operable and inoperable state, respectively. A side piece of this nature is particularly advantageous for one-handed use.

In particularly preferred embodiments, the cover for the segment of the base section defining at least one aperture is a capped tube, the cap portion of which defines the spray hole and the interior side wall of which fits snugly over the exterior side wall of a tube projecting outwards from the base section, as previously described.

The moveable member may comprises a restraining means that interacts with the base section to prevent movement of the cover defining the spray hole beyond a pre-set distance from the blocking means, the device being in an operable state when the cover is at said pre-set distance from the blocking means. Said restraining means or another may also interact with the base section to provide resistance to the movement of the cover defining the spray hole away from the position in which the spray hole is blocked from within by the blocking means. Preferably the moveable member comprises a restraining means that can accomplish both of these functions.

The spray hole preferably has a maximum cross-sectional size of 1 mm or less, more preferably 0.6 mm or less. The spray hole preferably has a circular cross-sectional shape and preferably expands in cross-sectional size towards the exterior.

The dip-tube linking the dispensing cap with the lower region of the deformable plastic bottle is received by the dispensing cap in a way that enables flow of the liquid composition from the lower region of the bottle into the dispensing cap upon squeezing of the deformable bottle. The dip-tube preferably extends to the bottom of the deformable plastic bottle. Typically the dip-tube is manufactured from polyethylene and has a degree of flexibility. Typically the bore of the tube is from 0.5 mm to 1.5 mm and the thickness of the tube wall is from 0.2 mm to 0.7 mm.

Having described the invention in general terms, an embodiment according to the present invention will now be described more fully by way of example only and with reference to the accompanying drawings, in which.

All of the "tubes" and "tubular" structures referred to in the following description are of circular cross-section, unless otherwise stated.

Figure 1:
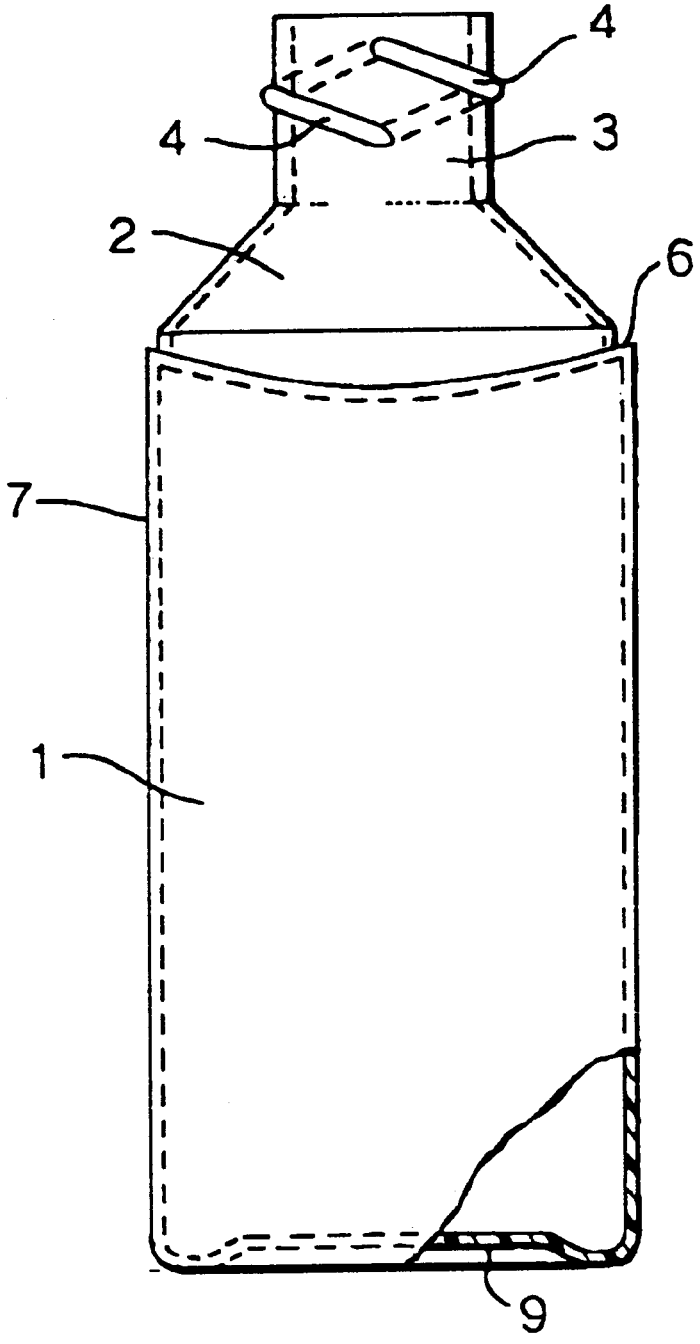
FIG. 1 represents the deformable plastic bottle (1)

The deformable plastic bottle (1) represented in FIG. 1 is a tubular bottle that narrows via a conical section (2) to a neck portion (3) having a screw thread (4) for engagement with the dispensing cap (5) illustrated in FIG. 2. Towards the top of the bottle (1), just below the conical section (2), there is an indentation (6) in the sidewall (7) into which the skirt (8) of the dispensing cap (5) fits. The central region of the base (9) is slightly raised towards the interior of the bottle (1).

Figure 2A:
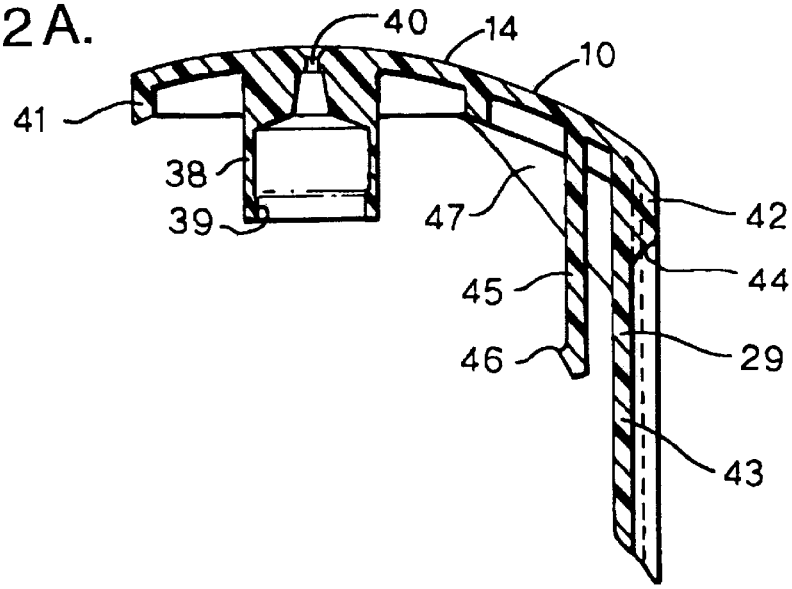
FIG. 2 represents the dispensing cap (5), FIG. 2B representing the base section (5B) and FIG. 2A representing a side view of the (removed) moveable member (10)
Figure 2B:
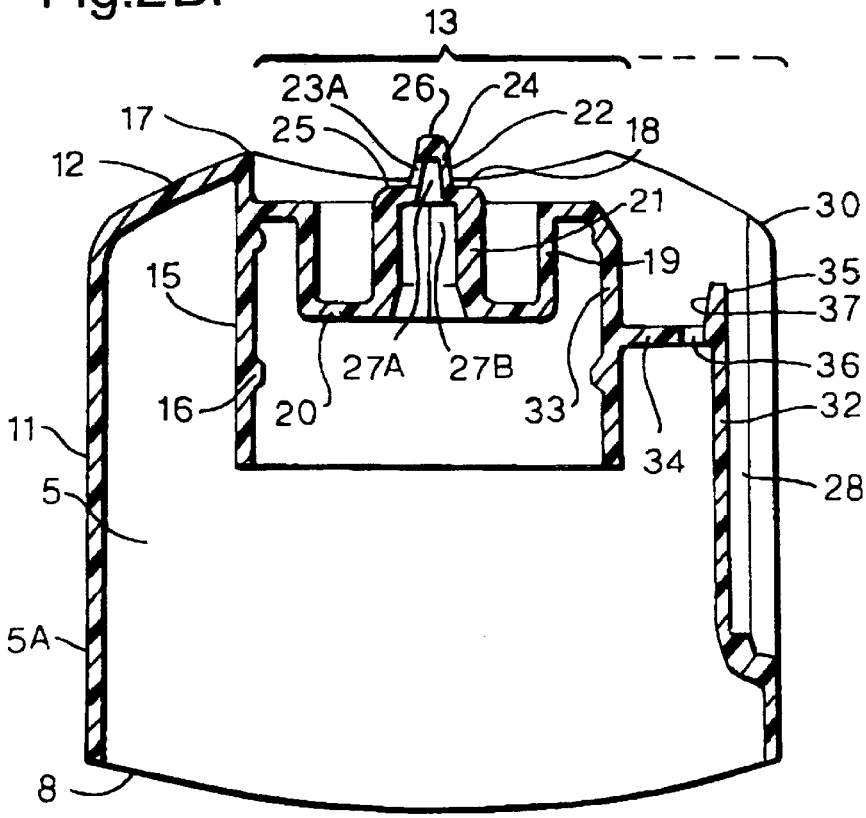

The dispensing cap (5) is represented in FIG. 2, with FIG. 2B representing the base section (5B) and FIG. 2A representing the moveable member (10), in order to aid the clarity of the representation. The base section of the dispensing cap (5B) is of circular cross-section and comprises an outer skirt (11) and a domed top (12), missing a portion (13) in the centre, into which a domed section (14) of the moveable member (10) (see FIG. 2A) fits. From the inner side of the domed top (12), there projects downwards a tube (15) having a screw thread (16) on its inside surface for engagement with a screw thread (4) on the neck portion (2) of the deformable plastic bottle (1), illustrated in FIG. 1. Within the downward projecting tube (15), above the level screw thread (16), there is a shelf (18), orthogonal to the longitudinal axis of the downward projecting tube (15), from which an inner tube (19) projects downwards, towards the interior of the device. The inner tube (19) has a flat lower end (20), from which a further tube (21) projects upwards, i.e. outwards from the base section (5B). The latter tube (21) has a circular external cross-section, but a triangular internal cross-section (see FIG. 5). At the outer end of the outward-projecting tube (21), roughly level with the shelf (18), there is a segment (22) of the base section (5B) that defines three apertures (23), only one of which (23A) is illustrated in FIG. 2B. This segment (22) is an outward-projecting tube centrally located atop the aforementioned outward-projecting tube (21) and sharing a common axis therewith. The segment is narrower than the outward-projecting tube (21) throughout its height and narrows towards its outer end, giving it a frusto-conical shape. The three apertures (23) are equally-spaced slits in a sidewall (24) of the segment (22) that run longitudinally from the covered top (25) of the outward-projecting tube (21), up to a flattened stopper (26) at the outer end of the segment (22). The bore (27A) of the segment (22) and the bore (27B) of the upward-projecting tube (21) are in fluid connection with each other and with the interior of the deformable plastic bottle (1), when the latter is screwed into place. The flattened stopper (26) serves as the blocking means for the spray hole (40) and the bore (27B) of the upward-projecting tube (21) serves as the receiver for the dip-tube (50) (vide infra).

At one side of the dispenser cap (5), there is an indentation (28) in the outer skirt (11), covering an arc of dimension slightly less than one quarter of the circumference of the dispenser cap. A side piece (29) of the moveable member (10) illustrated in FIG. 2A fits, in part, into this indentation (28). The indentation (28) shelves rapidly inward from near the bottom of the skirt (11) and extends at the-same depth to the top (30) of skirt (11). The indentation (28) has grooves (31) in its sides (see FIG. 5), in order to aid the retention of the moveable member (10). At a point approximately 20% from the height of the shelf (18) (using the lower end of the indentation (28) as the starting point), the wall (32) of the indentation (28) shelves orthogonally inward until it meets the outer wall (33) of the inner downward projecting tube (15). At the outer edge of the platform (34) so formed, and centrally located within the arc of the indentation (28), there is an upward-projecting rectangular continuation (35) of the wall (32). Adjacent to the lower edge of the upward-projecting rectangular continuation (35) there is a rectangular hole (36) in the shelf (34). The inside surface (37) of the upward-projecting rectangular continuation (35) slopes inwards towards the hole (36).

The moveable member (10), as illustrated in FIG. 2A, comprises a domed top section (14) and a side piece (29). From the underside of the domed top section (14), there projects a tubular section (38), shaped to fit over the upward-projecting tube (21) and the segment (22) of the base section (5B) that defines the three apertures (23) (see FIG. 2B). The domed top section (14) and the tubular section (38) serve as a cover for the segment (22) of the base section (5B) that defines the three apertures (23). The domed top section (14) is substantially orthogonal to the top-bottom axis of the device. A ridge (39) on the inside of the tubular section (38) at the bottom contacts the upward-projecting tube (21), aiding its snug fitting over said tube (21). The flattened stopper (26) serves as a blocking means for the spray hole (40) defined by the top section (14) of the cover [(14) and (38)] for the segment (22), when the device is in the inoperable state. Flattened stopper (26) does not block the spray hole (40) when the moveable member (10) is slid slightly upwards to give the operable state. The spray hole (40) expands in diameter towards the outside. From the lower edge of the domed top section (14), a short skirt (41) projects downwards and fits within the portion of the tube (15) above the shelf (18).

Figure 3:
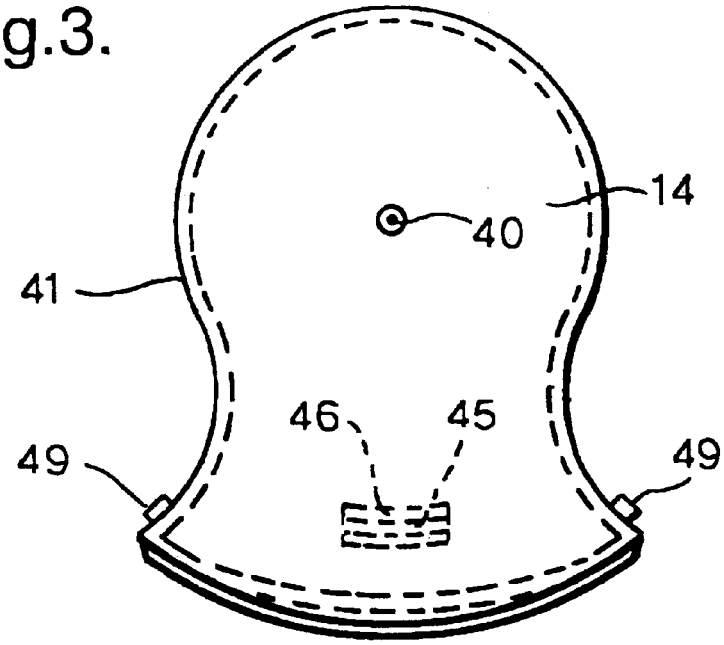
FIG. 3 represents a top view of the (removed) moveable member (10)
Figure 4:
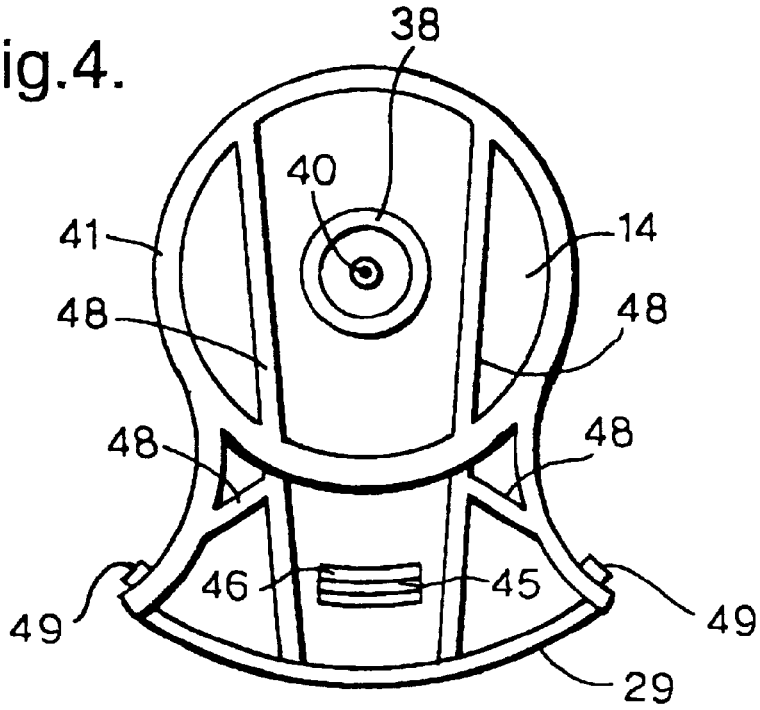
FIG. 4 represents a bottom view of the (removed) moveable member (10)

The central portion of top section (14) expands outwards towards the side piece (29), as illustrated in FIGS. 3 and 4. With reference to FIGS. 2A and 2B, the side piece (29) fits up against the wall (32) of the indentation (28) and fits into said indentation (28). The side piece (29) is thicker in an upper section (42) and shelves obliquely inward, forming a thinner lower section (43). The oblique shelf (44) aids the user of the device in pushing the moveable member (10) upwards and in using the device one-handedly.

The movement of moveable member (10) is restricted by a strut (45) of rectangular cross-section that projects downwards from the top section (14) and passes through the hole (36) in the platform (34). The sloping surface (37) functions to push the strut (45) towards the central axis of the device and a retaining catch (46) serves to prevent the moveable member (10) being slid upwards beyond the point at which the retaining catch (46) contacts the underside of the shelf (34). Support members (47) at sides of the moveable member (10) help to strengthen the link between the domed top section (14) and the side piece (29).

With further reference to FIGS. 3 and 4, the short skirt (41) is supported by short strengthening structures (48), projecting downwards from the underside of domed top section (14). Also illustrated in FIGS. 3 and 4 is the tubular section (38), the spray hole (40), the strut (45) and its retaining catch (46), and projections (49) that fit into the grooves (31) (see FIG. 5) and help to hold the side piece (29) in place.

Figure 5:
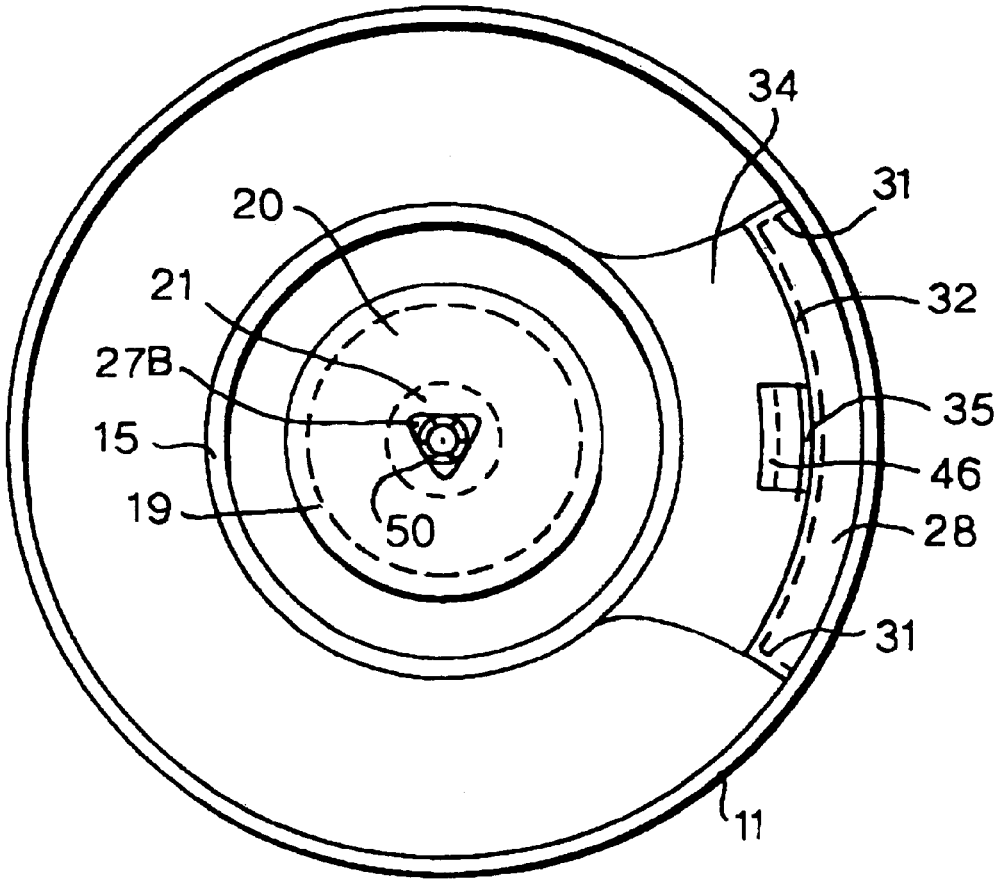
FIG. 5 represents a view from the underside of dispenser cap (5), with the moveable member (10) in place.

FIG. 5 illustrates the position of the grooves (31), in relation to the wall (32) of the indentation (28) and the outer skirt (11). Also illustrated is the lower side of the platform (34) and its upward-projecting rectangular continuation (35); the retaining catch (46); the tube (15) that projects downwards from inner side of the domed top (12) of the base section (5B); the inner downward-projecting tube (19), the bottom of its flat lower end (20), and the tube (21) that projects upwards therefrom; and the triangular cross-section of the bore (27B) of the upward-projecting tube (21). The dip-tube (50) is shown in cross-section within the triangular bore (27B) of the upward-projecting tube (21), the relative dimensions being such that the dip-tube (50) is retained by the upward-projecting tube (21) when pushed into the triangular bore (27B).

What is claimed:

1. A squeeze spray device comprising a deformable bottle for holding a liquid composition, a leave-in-place dispenser cap attached to the deformable bottle, and a dip-tube, one end of said dip-tube being received by the dispenser cap and the other end terminating inside the deformable bottle; said dispenser cap comprising:

a) a base section, comprising a means for attachment to the deformable bottle, a segment defining at least one aperture and a receiver for the dip-tube on the interior face of said segment, the at least one aperture providing fluid connection between the interior of the deformable bottle and exterior to the base section, both via the dip-tube and otherwise; and b) a moveable member, retained exterior to the base section, comprising a cover for said segment of the base section, said cover defining a spray hole;

the moveable member functioning to change the device between an inoperable state in which the spray hole is blocked from within by a blocking means that forms a part of the base section and an operable state in which the cover defining the spray hole is at a distance from said blocking means, wherein, the receiver for the dip-tube is in the interior of a tube having a polygonal interior cross-section, said tube projecting outwards from the base section and wherein, in operation, the segment of the base section defining at least one aperture and the cover therefor form a swirl chamber where air and a liquid composition expelled from the deformable bottle are mixed together prior to exiting through the spray hole.

2. A squeeze spray device according to claim 1, wherein the moveable member comprises a restraining means that interacts with the base section to prevent movement of the cover defining the spray hole beyond a pre-set distance from the blocking means, the device being in an operable state when the cover is at said pre-set distance from the blocking means.

3. A squeeze spray device according to claim 1, wherein the moveable member comprises a restraining means that interacts with the base section to provide resistance to the movement of the cover defining the spray hole away from the position in which the spray hole is blocked from within by the blocking means.

4. A squeeze spray device according to claim 1, wherein the device is changeable between its operable and its inoperable states by sliding the cover away from and towards the blocking means, respectively.

5. A squeeze spray device according to claim 1, wherein the device is changeable between its operable and its inoperable states by screwing the cover away from and towards the blocking means, respectively.

6. A squeeze spray device according to claim 1, wherein the segment of the base section defining at least one aperture defines more than one aperture and each aperture independently provides fluid connection between the interior of the deformable bottle and exterior to said segment of the base section both via the dip-tube and otherwise.

7. A squeeze spray device according to claim 1, wherein the segment of the base section defining at least one aperture defines more than one aperture and one or more apertures provide fluid connection between the interior of the deformable bottle and exterior to said segment of the base section without fluid connection via the dip-tube.

8. A squeeze spray device according to claim 1, wherein the segment of the base section defining at least one orifice defines at least three orifices.

9. A squeeze spray device according to claim 7, wherein the segment of the base section defining at least three orifices defines a number of orifices equal to the number of sides of the portion of the interior of the tube of polygonal cross-section.

10. A squeeze spray device according to claim 7, wherein the interior of the tube having a polygonal cross-section has a triangular cross-section.

11. A squeeze spray device according to claim 1, wherein the cover for the segment of the base section defining at least one aperture is a capped tube, the cap portion of which defines the spray hole and the interior side wall of which fits snugly over the exterior side wall of the tube projecting outwards from the base section.

12. A squeeze spray device according to claim 1, wherein the segment defining the at least one aperture is tubular in overall shape.

13. A squeeze spray device according to claim 12, wherein the tubular segment defining the at least one aperture is closed at its outer end by the blocking means.

14. A squeeze spray device according to claim 13, wherein the segment defining the at least one aperture is frusto-conical.

15. A squeeze spray device according to claim 12, wherein the at least one aperture is a slit running longitudinally through the wall of the tubular section.

16. A squeeze spray device according to claim 12, wherein the tubular segment defining the at least one aperture is located centrally at the outer end of the tube having a polygonal interior cross-section and shares a common axis therewith.

17. A squeeze spray device according to claim 16, wherein the tubular segment defining the at least one aperture has a smaller maximum outer dimension orthogonal to the axis than the corresponding outer dimension of the tube having a polygonal interior cross-section.

18. A squeeze spray device according to claim 1, wherein the dispenser cap comprises an outer skirt that fits over the upper part of the deformable bottle.

19. A squeeze spray device according to claim 18, wherein the lower edge of the outer skirt is saddle-shaped and fits into a corresponding indentation in the side wall of the deformable bottle.

20. A dispenser cap suitable for use as part of a squeeze spray device according to claim 1.

21. A method of topical application of a liquid cosmetic composition comprising the use of a squeeze spray device according to claim 1.

22. A method of topical application of a liquid deodorant composition according to claim 21.

23. A consumer product comprising a squeeze spray device as described in claim 1 containing a liquid composition.

24. A consumer product according to claim 23, wherein the liquid composition is a deodorant or antiperspirant composition suitable for topical application to the human body.

25. A consumer product according to claim 23, wherein the liquid composition comprises a C2 to C4 alcohol.

* * * * *